US005806380A

United States Patent [19]

Wilsey

[11] Patent Number: 5,806,380

[45] Date of Patent: Sep. 15, 1998

[54] BOAT PLUG WRENCH

[76] Inventor: Gary Alan Wilsey, 6918-115th Pl. SE., Newcastle, Wash. 98056

[21] Appl. No.: 696,565

[22] Filed: Aug. 16, 1996

[51] Int. Cl.[6] ..... B67B 7/44

[52] U.S. Cl. ..... 81/3.09; 81/125; 81/125.1; 7/151

[58] Field of Search ..... 81/3.09, 3.4, 124.3, 81/125, 125.1, 180.1, 184, 120; 7/100, 138, 151, 169, DIG. 1; 294/93, 99.1

[56] References Cited

U.S. PATENT DOCUMENTS

| | | | |
|---|---|---|---|
| D. 176,005 | 11/1955 | Cariello | D54/16 |
| D. 194,708 | 2/1963 | Fink | D54/16 |
| 873,437 | 12/1907 | Jeffrey | 81/125.1 |
| 999,399 | 8/1911 | Reed | 81/125.1 |
| 1,040,564 | 10/1912 | Merrill | 7/151 |
| 1,761,988 | 6/1930 | Layhon | 81/125 |
| 2,750,828 | 6/1956 | Wendling | 81/125 |
| 4,835,860 | 6/1989 | Infeld | 7/151 |

*Primary Examiner*—James G. Smith
*Assistant Examiner*—Lee Wilson
*Attorney, Agent, or Firm*—Graybeal Jackson Haley LLP

[57] ABSTRACT

A device for removing and storing a boat's drain plug having a wrench body with an integral wrench head at one end and a plug retaining ring the other end. The retaining ring includes a grommet, formed from an elastomeric material, of a shape and configuration to grip the sides of a boat drain plug and hold it securely in place. A magnet assembly is permanently mounted on bottom side of the wrench body.

17 Claims, 1 Drawing Sheet

BOAT PLUG WRENCH

FIELD OF THE INVENTION

The present invention relates generally to a device for removing boat plugs, and more particularly to a device which includes a wrench that can be used to remove and store a boat's drain plug.

BACKGROUND OF THE INVENTION

Almost all sailboats and motorboats that are designed to be removed from the water for storage or transport have a drain hole and drain plug. The drain hole allows for the easy removal of water from the boat when it is out of the water and the drain plug is used to close the hole prior to putting the boat in the water. Drain plugs are typically made of a non-corrosive metal and have an externally threaded cylindrical piece at one end so they can be securely fastened into place. Drain plugs often have a square end, similar to a bolt head, opposite the threaded end and can be installed and removed with a wrench.

While a drain hole and drain plug provide a simple and effective solution to the problem of removing water from a boat, there is always the problem of what to do with the drain plug when it is not in use. Because drain plugs are relatively small, often measuring less than an inch in length, they have a tendency to get lost. If a boat's drain plug is lost while preparing the boat for launch it can often be difficult if not impossible to replace the plug or fashion a feasible substitute on short notice. At the very least it can be very frustrating to misplace or lose a boat's drain plug, not to mention a wrench to tighten it in place.

There is a need for a device that can unfasten and store a boat's drain plug. There is yet a further need for a device that can unfasten and store a boat's drain plug which has a reduced potential for being lost itself.

SUMMARY OF THE INVENTION

The inventive device incorporates a wrench which is specifically designed to fit standard drain plugs. The device also incorporates a plug retaining ring which securely stores the drain plug after it has been removed from the boat. The present invention is also provided with a magnet which allows the device, along with the secured drain plug, to be attached to a convenient metal surface.

In actual use the wrench is used to remove the drain plug, the plug is stored in the plug retaining ring, and the magnet is used to attach the device to a convenient metal surface. If the drain plug is the type that is removed from the outside of the boat, it makes sense to attach the device to the metal surface of the boat trailer close to the drain hole.

These and other features of the present invention will be more fully appreciated when considered in light of the following detailed description and drawings.

DETAILED DESCRIPTION OF THE INVENTION

Figure 1:
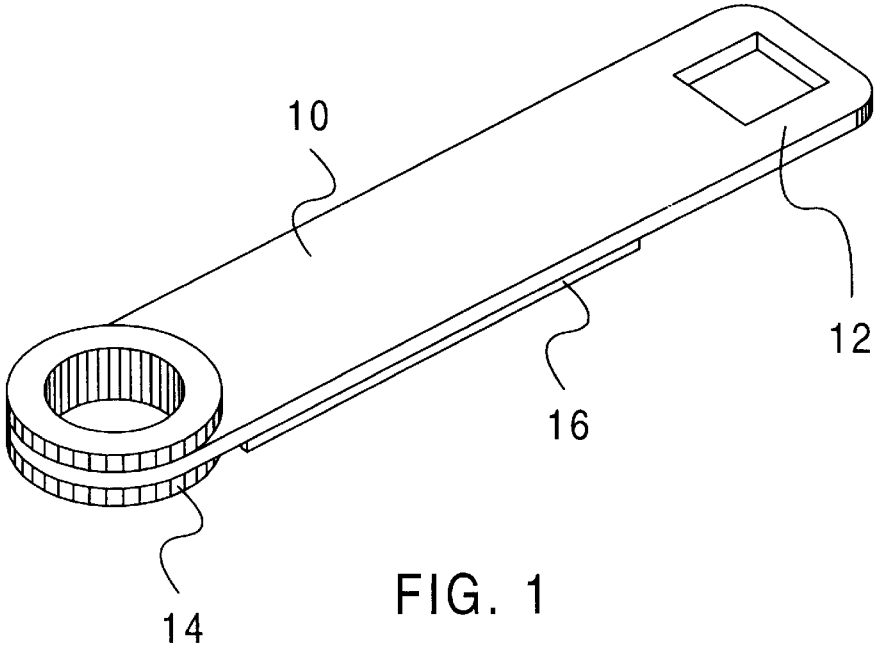
FIG. 1 is an orthographic view of the preferred embodiment of the present invention.

FIG. 1 illustrates the wrench body 10 having an integral wrench head 12 at one end and a plug retaining ring 14 at the opposite end. A magnet assembly 16 is permanently mounted on the bottom side of the wrench body 10.

Wrench body 10 can be manufactured out of any suitable corrosion resistant material and may be stamped out from a single piece of metal. In the preferred embodiment, wrench body 10 is formed out of 304 stainless steel.

Wrench head 12 is sized so as to accommodate the removal of a standard drain plug. In the preferred embodiment, wrench head 12 is a four sided close-end wrench head. In the most preferable embodiment, wrench head 12 is a square aperture having sides measuring between 0.600 inches and 0.650 inches. In the preferred embodiment, the square aperture is designed to meet ASTM standards for pipe fittings. Additionally, alternate types of wrench heads, including open-end, long-box, monkey, Stilson, and socket wrench heads, could be used in the present invention.

Plug retaining ring 14 is comprised of a grommet fitted into an aperture in wrench body 10. Plug retaining ring 14 is of a size and configuration to securely grip a typically sized drain plug after it has been removed from the drain hole. In the preferred embodiment, the grommet in plug retaining ring 14 is formed from an elastomeric material. One preferred elastomeric material is Neoprene, a rubber compound that is not attacked by sunlight or oils often found in a marine environment.

Figure 2:
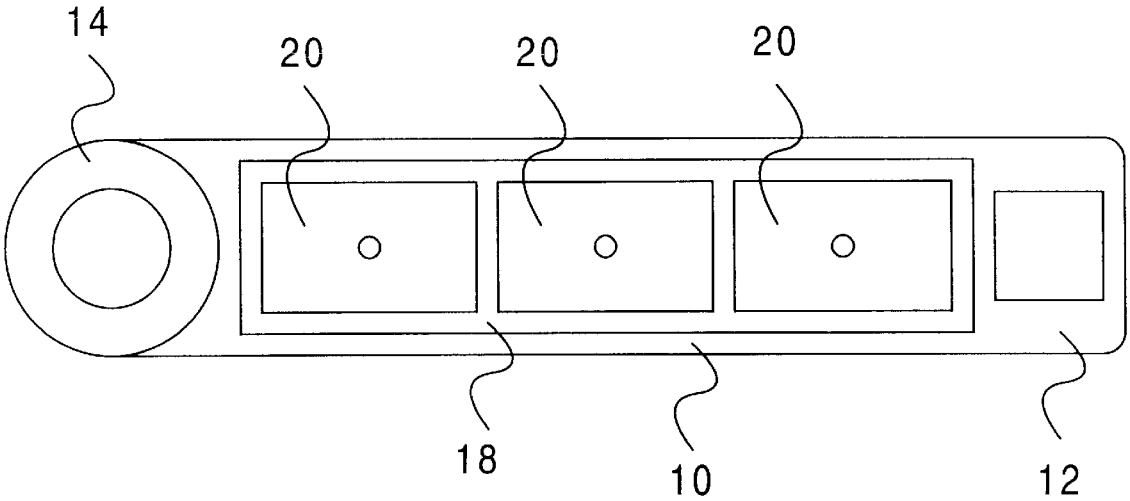
FIG. 2 is an isometric view, taken from the bottom side, of the preferred embodiment of the present invention.

FIG. 1 and FIG. 2 show a preferred embodiment in which magnet assembly 16 is comprised of a protective sleeve 18 and a plurality of magnets 20. The protective sleeve 18 is generally made out of metal in order to increase the effectiveness of the magnets 20 and may be nickel plated, or provided with a protective coating, to increase corrosion resistance. Any number of magnets 20 may be used. Additionally, a protective coating to provide rust protection may be applied to the magnets 20. In one preferred embodiment, the magnet assembly is bonded to the bottom side of the wrench body 10 with a water-proof epoxy.

From the foregoing teachings, it can be appreciated by one skilled in the art that a new, novel, and nonobvious wrench for removing and storing boat drain plugs is disclosed. It is to be understood that various modifications, adaptations, and equivalents will be apparent to those skilled in the art to which the invention is addressed, and that the present invention is not to be limited by the foregoing description but only by the appended claims.

We claim:

1. A device for removing and demountably storing a boat drain plug comprising:

a wrench body having a first end, a second end, a top side, and a bottom side;

a wrench head integral with said first end; and a plug retaining ring integral with said second end, wherein said plug retaining ring includes a grommet of a shape and configuration to grip the sides of a boat drain plug.

2. The device of claim 1, wherein said grommet is formed from an elastomeric material.

3. The device of claim 2, wherein said wrench head is a close-end wrench head.

4. The device of claim 3, wherein said close-end wrench head is a four sided close-end wrench head.

5. The device of claim 4, wherein at least two sides of said four sided close-end wrench head measure between 0.600 inches and 0.650 inches.

6. The device of claim 5, further comprising:

magnet assembly permanently mounted on said bottom side.

7. The device of claim 6, wherein said magnet assembly is comprised of at least one magnet permanently mounted inside a protective sleeve.

8. The device of claim 7, wherein said magnet has a permanent protective coating.

9. The device of claim 8, wherein said protective sleeve has a permanent protective coating.

10. A device for removing and demountably storing a boat drain plug comprising:

a wrench body having a first end, a second end, a top side, and a bottom side;

a wrench head integral with said first end;

a plug retaining ring integral with said second end and including a grommet, formed from an elastomeric material, of a shape and configuration to grip the sides of a boat drain plug; and a magnet assembly permanently mounted on said bottom side.

11. The device of claim 10, wherein said wrench head is a close-end wrench head.

12. The device of claim 11, wherein said close-end wrench head is a four sided close-end wrench head.

13. The device of claim 12, wherein at least two sides of said four sided close-end wrench head measure between 0.600 inches and 0.650 inches.

14. The device of claim 10, wherein said magnet assembly is comprised of at least one magnet permanently mounted inside a protective sleeve.

15. The device of claim 14, wherein said magnet has a permanent protective coating.

16. The device of claim 15, wherein said protective sleeve is nickel plated.

17. A device for removing and demountably storing a boat drain plug comprising:

a rectangular wrench body having a first end, a second end, a top side, and a bottom side;

a four sided close-end wrench head integral with said first end;

a plug retaining ring integral with said second end and including a grommet, formed from an elastomeric material, of a shape and configuration to grip the sides of a boat drain plug;

a nickel plated protective sleeve permanently mounted on a said bottom side; and a magnet permanently mounted inside said protective sleeve.

* * * * *